United States Patent [19]

Renault

[11] Patent Number: 4,873,934

[45] Date of Patent: Oct. 17, 1989

[54] ADJUSTABLE SHEET FOR A WINDSURFING HARNESS

[76] Inventor: Greg Renault, P.O. Box 832, La Jolla, Calif. 92038

[21] Appl. No.: 214,214

[22] Filed: Jun. 17, 1988

[51] Int. Cl.[4] ..... B63B 35/00

[52] U.S. Cl. ..... 114/39.2; 114/102; 114/218

[58] Field of Search ..... 114/39.1, 39.2, 97, 114/98, 102, 218; 182/3; 24/602, 698

[56] References Cited

U.S. PATENT DOCUMENTS 4,523,537 6/1985 Kowol ..... 114/39.2

FOREIGN PATENT DOCUMENTS 3305291 8/1983 Fed. Rep. of Germany ..... 114/39.2

*Primary Examiner*—Joseph F. Peters, Jr.
*Assistant Examiner*—Jesûs Sotelo
*Attorney, Agent, or Firm*—Selwyn S. Berg

[57] ABSTRACT

An adjustable sheet for a windsurfing harness on a boom of an articulated mast of a windsurfing board comprising an elastic element, one end of which is secured to the boom; a sheet which is attached to the other end of the elastic element; a dual-action clamp through which the sheet is routed; and a quick release element to disengage the dual action clamp such that the sheet is disengaged from the dual-action clamp and the sheet may be elongated or shortened.

2 Claims, 8 Drawing Sheets

ADJUSTABLE SHEET FOR A WINDSURFING HARNESS

BACKGROUND OF THE INVENTION

The sport of windsurfing has grown rapidly. In the United States in the mid-1960's, there appeared two published accounts of "sail boards" carrying hand held sails. The first account was by a Pennsylvania inventor named S. Newman Darby, and the other by a southern Californian, Jim Drake, describing efforts by himself and others, such as Hoyle Schweitzer who has become the manufacturer of sail boards known as the "Windsurfer". Darby published information on his design in Popular Science in August of 1965. Out of this first clumsy design improvements and developments by Drake and Schweitzer resulted in a patentable product. In 1969 the Rand Corporation of Santa Monica, Calif. published an article by James R. Drake on "Windsurfing—A New Concept in Sailing". It described a simple system of a sail board with a long slim haul and tailfin, a daggerboard, and an unsupported, universally hinged sail with wishbone booms. There were no mechanical devices, no pulleys or levers to come between the operator and the elements. There were no shrouds to support the rig, and no rudder to steer with. The skipper supports the sail by holding the boom and steers by utilizing the universal joint to vary the position of the sail. A fully articulated universal located on the foot of the mast permits the mast to be tilted fore and aft by the skipper which in turn causes the board to swing port starboard according to the wind conditions. However, the skipper must retain a grasp on the boom to control the mast. He has to position his hands and the weight of his body so as to maintain a balance on the sailboard in respect to the prevailing wind. This can be an exhausting experience and extremely fatiguing in respect to the constant grasp on the boom.

A harness was developed by the Charchulla brothers of Germany and gradually gained acceptance between 1975 and 1979.

The harness couples the weight of the skipper to the boom through a sheet. A padded sling is worn as a vest by the skipper. A hook attached to the center of the sheet engages the sling. The end of the sheet is attached to the boom. However, the standard arrangement of tying the sheet to the boom does not permit an easy adjustment to accommodate for changes in balance to accommodate the varying wind conditions one experiences in maneuvering the sailboard. The inventor has developed a novel system which permits simple and rapid adjustments of the sheet while under sail. It must be recalled that the universal articulation of the mast does not permit free use of one's hands in making adjustments. The described system permits simple and fast adjustments so that the skipper does not lose control of his tack.

SUMMARY OF THE INVENTION

As mentioned above, the skipper on the sailboard must constantly adjust his balance to accommodate his tack. The currently available harness has a sheet which is tied to the boom with knots. If the sheet is attached to the boom by means of straps, only 3 to 4 feet is needed. If it is tied, 5 to 6 feet is needed. The ends are tied about 8 inches apart with about 10 inches of slack between the sheet and the boom. A hook is built into the sheet which can be attached to the harness. In the inventor's system the sheet has an elastic segment attached to one end of his extremity and the distal end of the elastic segment is connected to a hook on the boom. The sheet emerges from the boom through a hole and is threaded through a dual acting clamp attached to the boom. The dual acting clamp contains 2 cams. The cams have pawls which are held against the sheet by a spring action. The cams also have lugs. A button is on the exterior of the clamp and when this button is depressed it pushes the cams which lift the pawls that hold the sheet. One can then extract more sheet by pulling on the hook or shorten the sheet by releasing the forces on the hook. The tension from the expansive segment locks one of the cams and the body weight pulling on the sheet locks the other cam. The spring tension operating the cams secure the pawls against the sheet. The skipper thus managed to adjust the length of the sheet by a simple maneuver of depressing a button on the clamp. He did not release the boom from his grasp to do this. The clamp will be conveniently located adjacent to one of his hands so that the actuation of the quick release button is a smooth maneuver. A surgical elastic tubing is available for the elastic segment. The same type of elastic tubing is commonly used in spear guns and is known to tolerate a salt water environment. The heart of the invention is the double action clamp. A double action is necessary because the sheet experiences counter-acting forces; one force originates from the elastic segment and acts to shorten the sheet; the counter-force results from the weight of the skipper pulling on the hook and tends to lengthen the sheet.

THE EMBODIMENT

Figure 1:
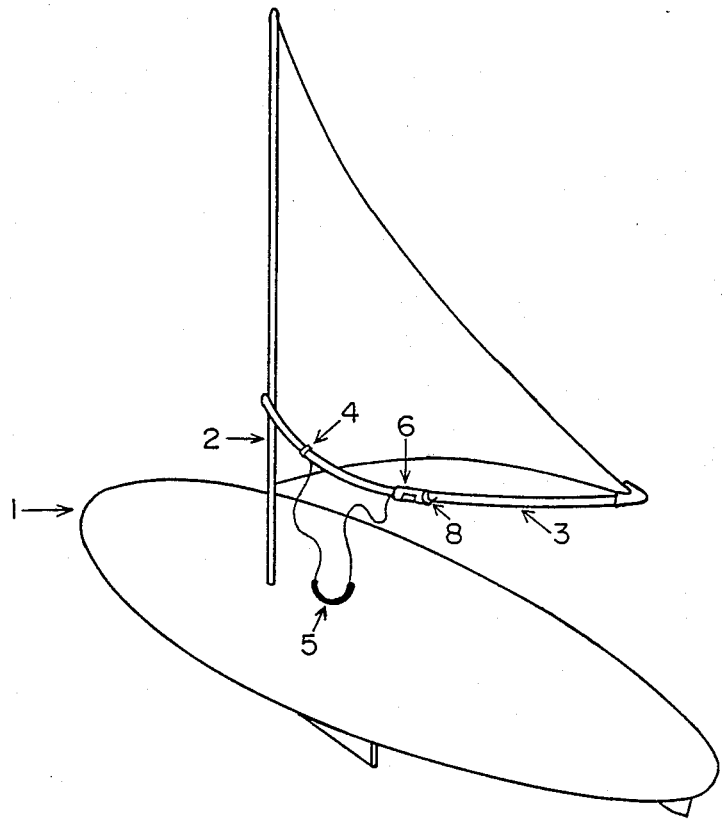
FIG. 1. The sailboard with its major components.
Figure 2:
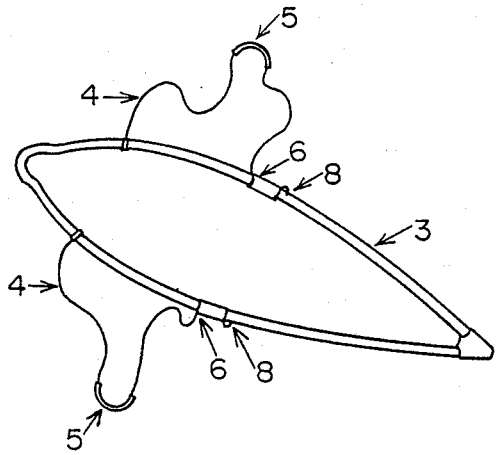
FIG. 2. The boom.

FIG. 1 shows the major components of the sailboard, which comprises the sailboard, 1, on which the skipper will balance. The articulated mast, 2, is joined to the sailboard by a universal, which is not shown in detail. The boom, 3, is rigidly tied to the articulated mast. The sail is stitched to the mast on one side and the stretch sail is held by a grommet to the extension of the boom. The sheet, 4, is tied to the boom, 3, at a point near the mast, 2, and extends through the hook, 5, and into a dual-acting clamp, 6. The sheet, 4, passes inside the boom, 3, through a hole in the boom, 8. FIG. 2 shows a plan view of the boom with the two sheets, 4. As aforementioned, the hook, 5, which travels on the sheet, 4, may be inserted onto the harness worn by the skipper. The harness will not be described or discussed, but is a vest system worn by the skipper which contains a mechanism which will engage the hook, 5.

Figure 3A:
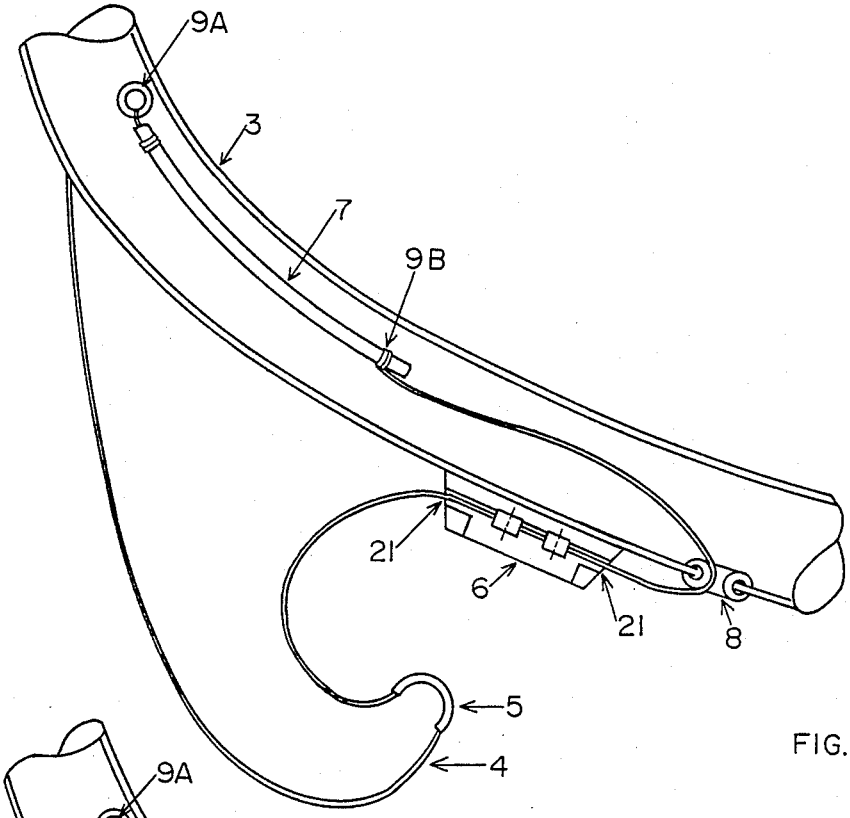
FIG. 3A. The relaxed elastic.
Figure 3B:
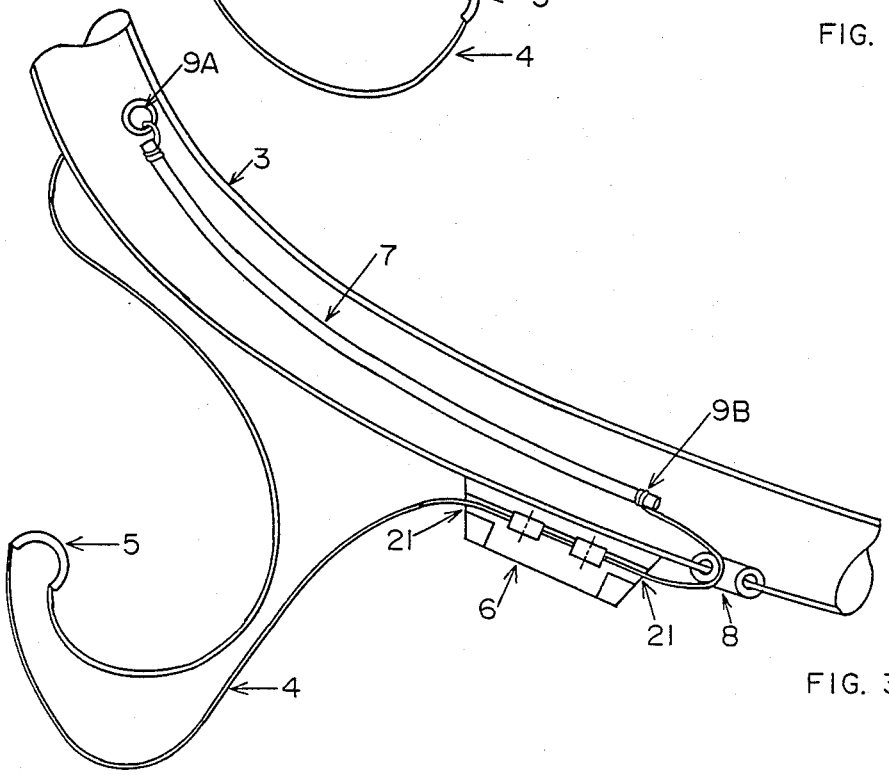
FIG. 3B. The tensioned elastic.

FIGS. 3A and 3B illustrate the functioning of the sheet as controlled by the components inside the boom.

Figure 4A:
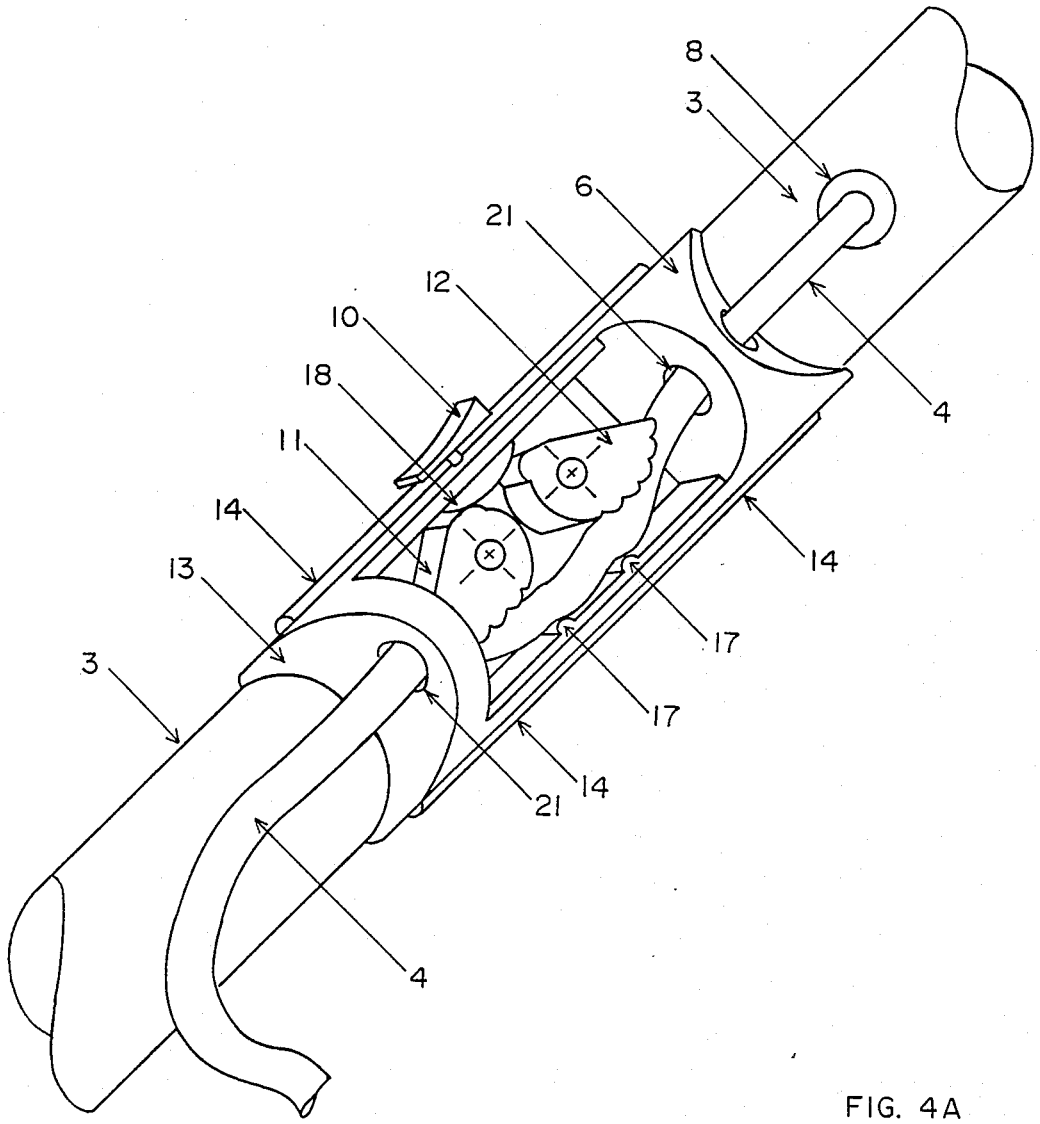
FIG. 4A. The body with sheet inside boom.
Figure 4B:
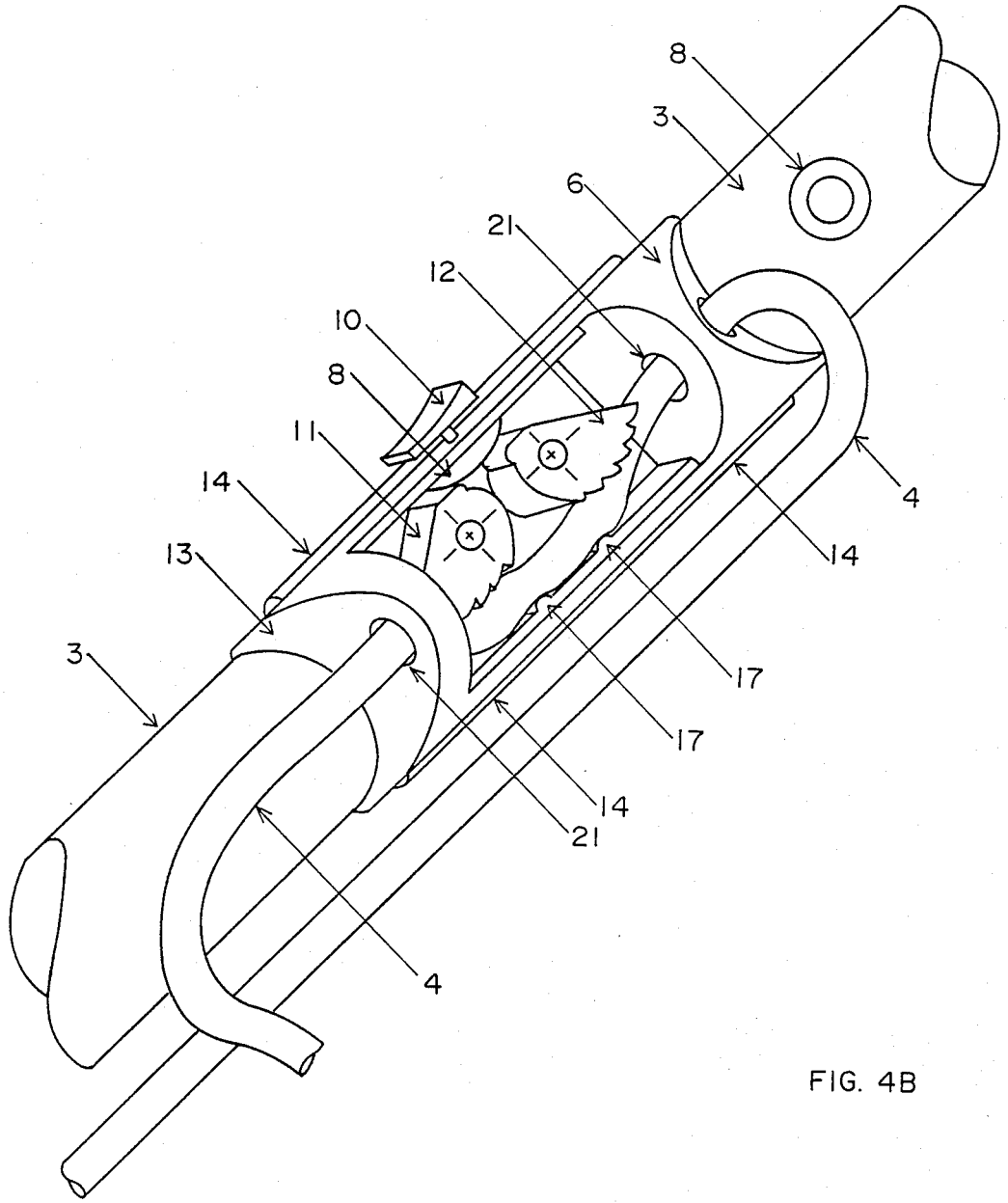
FIG. 4B. The body with sheet outside the boom.

FIG. 3A shows a relaxed elastic. An elastic (7) is tied to the inside of the boom by an elastic tie, 9A. On the other end of the elastic, 7, there is a tie to the sheet, 9B. FIGS. 3A and 3B show the sheet, 4, emerging from the inside of the boom through the boom hole, 8. It then goes through the dual-acting clamp, 6, and the sheet continues through the hook, 5, to its tie-point on the boom. FIG. 3A shows the elastic in its relaxed state. In FIG. 3B, forces have been applied to the hook and sheet, causing the elastic, 7, to be stretched from its tie-point to the boom, 9A, almost to the point where the tie-point of the elastic to the sheet, 9B, is adjacent to the boom hole, 8. The elastic, 7, which is used is of a generic type which has been employed as a power mechanism in spear guns used by scuba divers. This type of generic elastic has excellent resistence to deterioration caused by salt water. Implied in FIG. 3B is the locking action of the dual-action clamp, 6, which engages the sheet, 4. FIGS. 4A and 4B gives a pictorial of the sheet locked into the dual-locking clamp, 6. FIG. 4A shows the sheet routing through the boom and FIG. 4B shows the sheet routed outside the boom. The body of the clamp, 13, is attached to the boom by a body attachment, 14. The body attachment in the embodiment is a strong fabric which is laced through the body around the clamp in such a manner as to hold the dual-locking clamp, 6, onto the boom, 3. The sheet, 4, goes through a body hole, 21, passing underneath a spring-loaded cam, 12, which locks the sheet against a stop, 17. There is then a mirror image symmetric construction so that the sheet is locked against an opposing tension caused by the stretched elastic so that another spring-loaded cam, 11, locks the sheet against a stop, 17. The sheet continues out of the body, 13, through another body hole, 21.

Figure 5A:
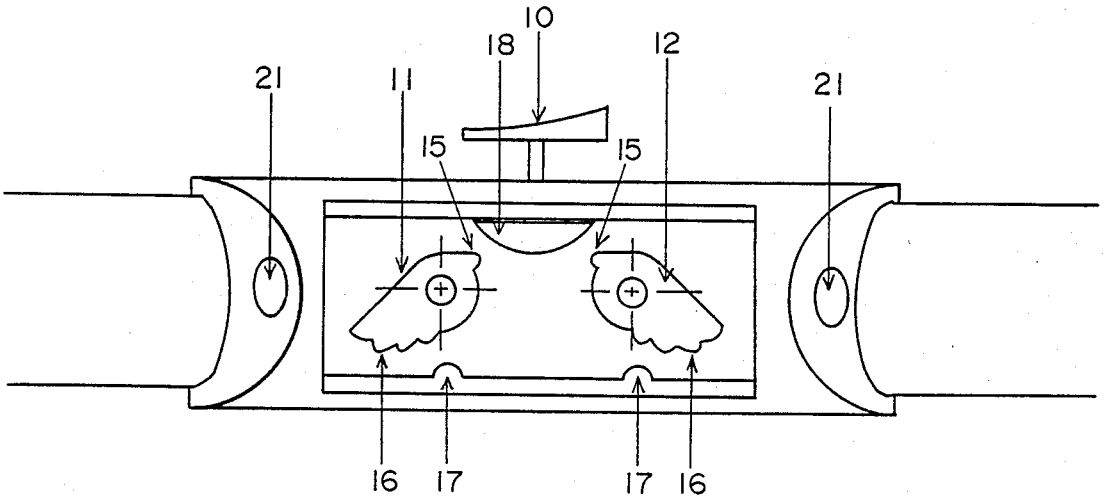
FIG. 5A. Cams locking the stops.
Figure 5B:
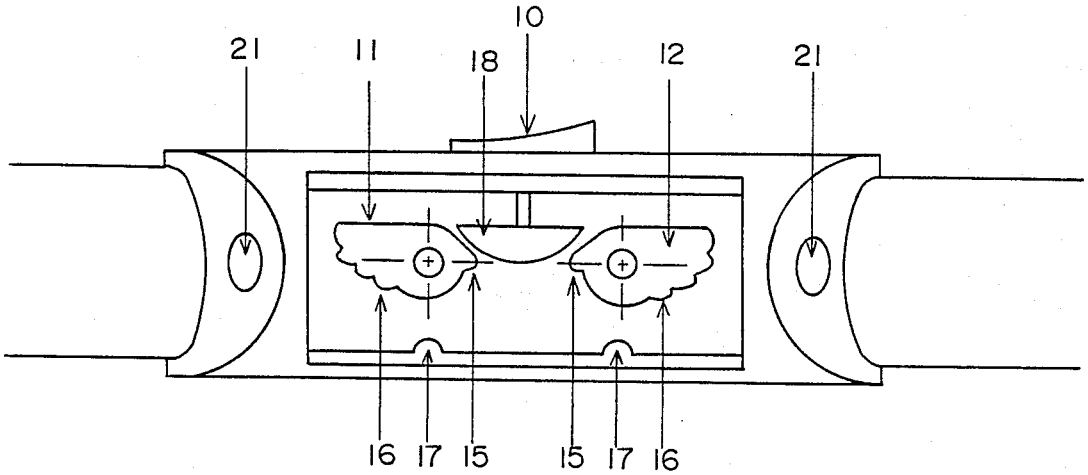
FIG. 5B. Cams releasing.

FIGS. 5A and 5B show the unlocking action. In FIG. 5A, the spring-loaded cams, 11 and 12, are shown in their fully-advanced positions. The release button, 10, has not been depressed. The cams almost contact the stops, 17. When the release button, 10, is depressed it extends a release cam, 18, which engages lobes, 15, on each of the cams, 11 and 12. The release cam, 18, contacts said lobes, 15, causing said cams to pivot away from the stops, 17. If a sheet were between the cams and the stop, the action of depressing the release button would cause the cams to disengage the sheet. Please note that each of the cams, 11 and 12, have serrations which act as pawls, 16, to engage the sheet in a locked position.

Figure 6C:
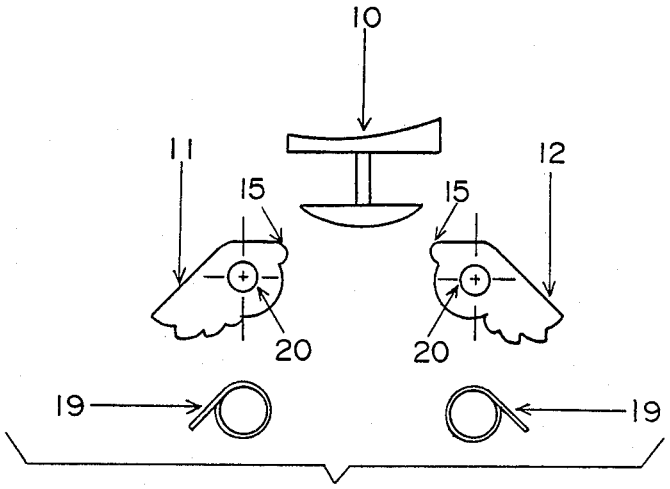
FIG. 6A. Body assembly showing components.
FIG. 6B. Body assembly showing components for ouside sheet routing.
Figure 6A:
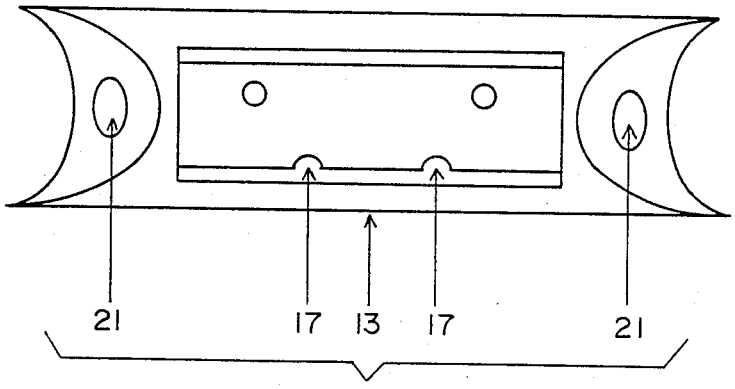
Figure 6D:
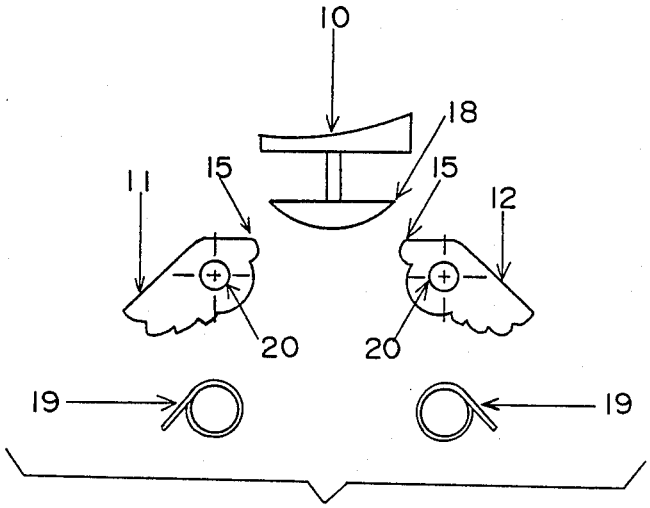
Figure 6B:
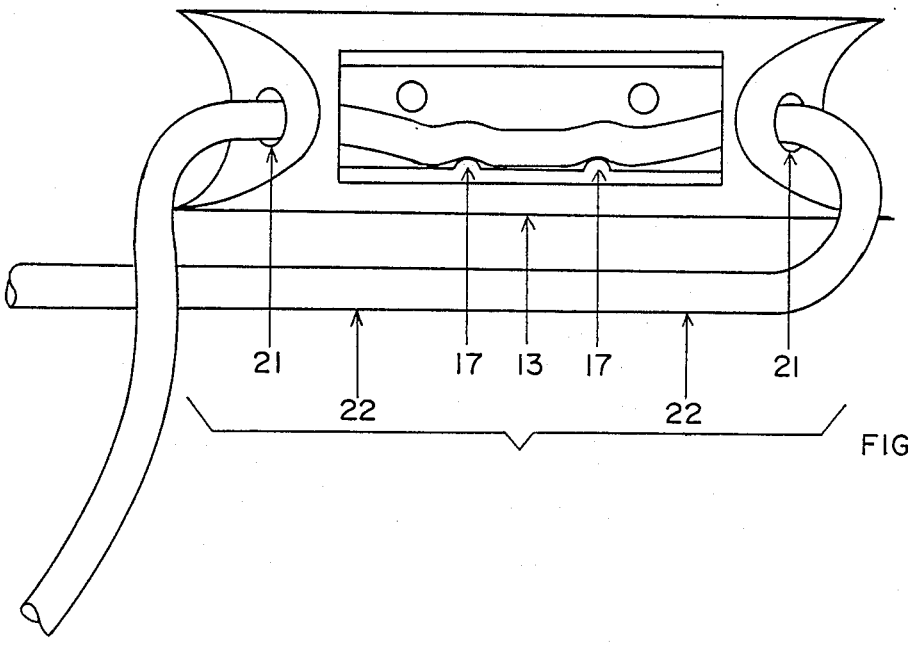
Figure 8:
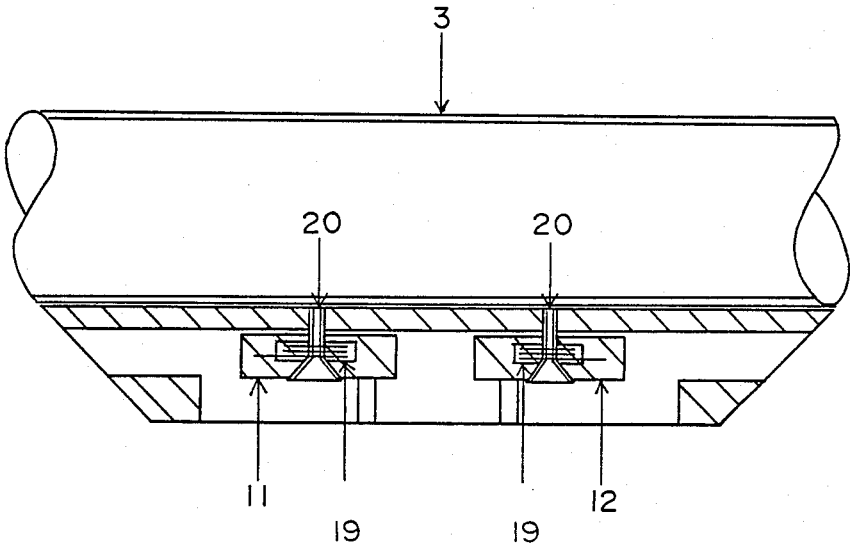
FIG. 8. Horizontal section view of body.
Figure 7:
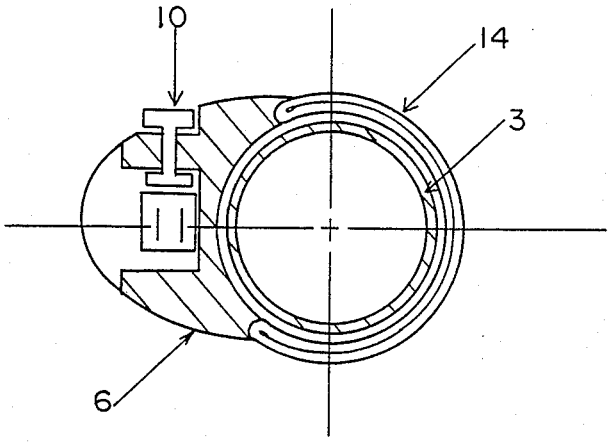
FIG. 7. Vertical section view of body.

FIGS. 6A and 6B are simplified blow-up views of the components in the body, 13. Springs, 19, are loaded into the cams, 11 and 12, and are held in place and attached to the body with screws, 20. The two cams, 11 and 12, are mirror symmetric and each has a lobe, 15, which is tripped by the release cam, 18, which is attached to the release button, 10. FIG. 7 shows a vertical sectional view of the body, 13, laced to the boom, 3, by the body attachment fabric, 14. FIG. 8 shows a horizontal section view of the body, illustrating the springs, 19, mounted inside the cams, 11 and 12, said cams being held by screws, 20. Said screws, 20, act as pivots for the cams.

In the embodiment, the weight of the skipper tensions the sheet, causing the elastic to stretch to some appropriate length provided the pawls are not engaged into the sheet. One can release the pawls from the sheet by depressing the release button. When the skipper ceases depressing the release button, the spring-loaded cams contact the sheet, and lock the sheet against the stops. The tension in the elastic pulls the sheet into the hole in the boom, further locking one of the cams even more tightly towards the appropriate stop. When the weight of the skipper is in excess of the tension in the elastic, it causes the other cam to lock more tightly on the sheet against its appropriate stop. Consequently, the clamp is dual-acting because the pawls on each of the cams resist motion either into the boom or towards the skipper. When the release button is depressed, the pawls of each of the cams disengage the sheet and the skipper may then adjust the length of the sheet by shifting the weight of his body against the tension caused by the elastic. This is all done without releasing his grasp on the boom so he may retain control of the position of the articulated mast at all times, especially at the critical time of changing his tack.

The inventor claims:

1. An adjustable sheet for a windsurfing harness on a boom of an articulated mast of a windsurfing board comprising:

an elastic means, one end of which is securely attached to said boom, a sheet which is attached to the other end of said elastic means, a dual-action clamp through which said sheet is routed, said dual-action clamp having a pair of mirror symmetrical cams, a multiplicity of serrated poles at the extremity of each of said cams to lock said sheet, a pivot means attaching said cams to said dual-action clamp, a spring means to tension to said cams against said sheet, and a quick release means to disengage said dual action clamp, so that in said dual-action clamp, said poles of said cams are tensioned through said pivots against said sheet locking said sheet in place so said sheet can not slide in either direction, and by actuating said quick release means, the sheet is disengaged from said dual-action clamp and said sheet may be elongated or shortened in accord with the tension of the elastic means to accommodate a new position of the boom and articulated mast.

2. A quick-release means as described in claim 1 comprising:

a button penetrating through said dual-action clamp, an arced head on the end of ssid button, a lobe on a perphery of each opposing grasping means which makes contact with said head, so that when the button is forcibly depressed, the head is pressed against the lobes on the opposing grasping means, causing said grasping means to release said sheet.

* * * * *